US009333506B2

(12) United States Patent
Tamura et al.

(10) Patent No.: US 9,333,506 B2
(45) Date of Patent: May 10, 2016

(54) VERTICAL ROLLER MILL

(71) Applicant: IHI Corporation, Tokyo (JP)

(72) Inventors: Masato Tamura, Tokyo (JP); Harufumi Murakami, Tokyo (JP)

(73) Assignee: IHI Corporation, Tokyo (JP)

( * ) Notice: Subject to any disclaimer, the term of this patent is extended or adjusted under 35 U.S.C. 154(b) by 254 days.

(21) Appl. No.: 14/232,710

(22) PCT Filed: Oct. 16, 2012

(86) PCT No.: PCT/JP2012/077174
§ 371 (c)(1),
(2) Date: Jan. 14, 2014

(87) PCT Pub. No.: WO2013/058395
PCT Pub. Date: Apr. 25, 2013

(65) Prior Publication Data

US 2014/0263786 A1 Sep. 18, 2014

(30) Foreign Application Priority Data

Oct. 20, 2011 (JP) ..... 2011-230313

(51) Int. Cl.
*B02C 25/00* (2006.01)
*B02C 15/04* (2006.01)

(52) U.S. Cl.
CPC ..... *B02C 15/04* (2013.01); *B02C 25/00* (2013.01)

(58) Field of Classification Search
CPC ..... B02C 15/04; B02C 25/00
USPC ..... 241/117–121
See application file for complete search history.

(56) References Cited

FOREIGN PATENT DOCUMENTS

JP 5-104011 A 4/1993
JP 9-103697 A 4/1997

(Continued)

OTHER PUBLICATIONS

International Preliminary Report on Patentability, with English translation, mailed May 1, 2014 in corresponding PCT application No. PCT/JP2012/077174.

(Continued)

*Primary Examiner* — Mark Rosenbaum
(74) *Attorney, Agent, or Firm* — Nields, Lemack & Frame, LLC

(57) ABSTRACT

A vertical roller mill, comprising a pulverization table (3) which is accommodated in a housing (2), and rotated and driven by a table driving apparatus, two or more pulverization rollers (4) which are pressed against the upper side of the pulverization table and pulverized massive lumps and two or more roller pressure units (5) which press the pulverization rollers, wherein each of the roller pressure unit comprises a hydraulic cylinder (13) which applies the pressing force to the pulverization roller and a hydraulic circuit connected to the hydraulic cylinder, wherein an accumulator communicates with a pressure oil supply path of the hydraulic circuit, a first on-off valve is provided at the downstream side of a communicating position of the accumulator in the pressure oil supply path, a first bypass path which communicates with the downstream side of the communicating position of the accumulator in the pressure oil supply path and communicates with the downstream side of the on-off valve, and bypasses the on-off valve is provided, a first orifice valve and a second on-off valve are provided in the first bypass path, wherein the first on-off valve is opened and the second on-off valve is closed in a steady operation of the vertical roller mill (1), the first on-off valve is closed and the second on-off valve is opened at a time of the occurrence of the self-excited vibration so that a flow of an oil to the hydraulic cylinder due to the self-excited vibration is caused through the first orifice valve.

4 Claims, 3 Drawing Sheets

(56) References Cited

FOREIGN PATENT DOCUMENTS

| | | | |
|---|---|---|---|
| JP | 9-248473 | A | 9/1997 |
| JP | 9-308834 | A | 12/1997 |
| JP | 10-128141 | A | 5/1998 |
| JP | 11-285649 | A | 10/1999 |
| JP | 2000-135446 | A | 5/2000 |
| JP | 2000-317326 | A | 11/2000 |
| JP | 2007-7594 | A | 1/2007 |

OTHER PUBLICATIONS

International Search Report mailed Jan. 22, 2013 in corresponding PCT application No. PCT/JP2012/077174.

VERTICAL ROLLER MILL

TECHNICAL FIELD

The present invention relates to a vertical roller mill that pulverizes massive lumps, such as coal, limestone, etc. into fine powder, and more particularly to a vertical roller mill that can suppress the self-excited vibration.

BACKGROUND ART

In a coal-fired boiler using coal as fuel, massive lump of coals are pulverized into a pulverized coal by a vertical roller mill or a horizontal ball mill, and the pulverized coal is supplied together with the primary air to a burner which is a combustion apparatus.

The vertical roller mill has a housing, a pulverization table accommodated in the housing, a pressure roller that is pressed against the pulverization table, and a pressure cylinder that presses the pressure roller against the pulverization roller provided in the housing, and the massive lump of coals are supplied to the pulverization table and pulverized by the pressure roller.

In the vertical roller mill, when the rolling resistance of the pressure roller is high, or when there is a fluctuation in the rolling resistance, a slip occurs between the pulverization table and the pressure roller, and the pressure roller may cause the self-excited vibration due to the slip.

Conventionally, when the self-excited vibration occurs, there is no effective means for stopping the self-excited vibration and the vertical roller mill itself must be stopped. Therefore, there occurs a problem, such that an operation rate reduces due to the supply stop of the pulverized coal, or a processing cost increases to restart the operation of the vertical roller mill.

In addition, there is a roller mill disclosed in Patent Document 1, wherein a catching side of a pulverization roller is inclined toward a central shaft side of a rotary table, thereby a toe-in angle is formed, also a link support, which has disc springs laminated, is provided between a pressure frame and a roller bracket, an excessive pendulum operation of the pulverization roller is suppressed to an appropriate level by the link support so that the operation can be stabilized, and the self-excited vibration is prevented.

Further, there is a method for operating a vertical mill disclosed in Patent Document 2, wherein a speed of a rotary table in a vertical roller mill is adjusted, a speed for catching a raw material in a pulverization roller is optimized, and the abnormal vibration caused due to a stick-slip phenomenon is avoided.

In view of the above-described problems, the present invention provides a vertical roller mill having with a function for suppressing the self-excited vibration.

PRIOR ART REFERENCES

Patent Document 1: JP-A-2000-317326
Patent Document 2: JP-A-2007-7594

DISCLOSURE OF THE INVENTION

The present invention relates to a vertical roller mill, comprising a pulverization table which is accommodated in a housing, and rotated and driven by a table driving apparatus, two or more pulverization rollers which are pressed against the upper side of the pulverization table and pulverized massive lumps and two or more roller pressure units which press the pulverization rollers, wherein each of the roller pressure unit comprises a hydraulic cylinder which applies the pressing force to the pulverization roller, and a hydraulic circuit connected to the hydraulic cylinder, wherein an accumulator communicates with a pressure oil supply path of the hydraulic circuit, a first on-off valve is provided at the downstream side of a communicating position of the accumulator in the pressure oil supply path, a first bypass path which communicates with the downstream side of the communicating position of the accumulator in the pressure oil supply path and communicates with the downstream side of the on-off valve, and bypasses the on-off valve is provided, a first orifice valve and a second on-off valve are provided in the first bypass path, wherein the first on-off valve is opened and the second on-off valve is closed in a steady operation of the vertical roller mill, the first on-off valve is closed and the second on-off valve is opened at a time of the occurrence of the self-excited vibration so that a flow of an oil to the hydraulic cylinder due to the self-excited vibration is caused through the first orifice valve.

Further, the present invention relates to the vertical roller mill, wherein a third on-off valve is provided at an oil drain path communicating with the hydraulic cylinder, a second bypass path that bypasses the third on-off valve is provided, a second orifice valve is provided in the second bypass path, wherein the third on-off valve is opened in the steady operation of the vertical roller mill, and the third on-off valve is closed at a time of the occurrence of the self-excited vibration so that a flow of the oil in the oil drain path due to the self-excited vibration is caused through the second orifice valve.

Further, the present invention relates to the vertical roller mill further comprising, a control apparatus and a vibration sensor for detecting the vibration, wherein the control apparatus judges the occurrence of the self-excited vibration based on a detection result of the vibration sensor and controls the opening/closing operations of the first on-off valve and the second on-off valve.

Furthermore, the present invention relates to the vertical roller mill further comprising a control apparatus and a vibration sensor for detecting the vibration, wherein the control apparatus judges the occurrence of the self-excited vibration based on a detection result of the vibration sensor and controls the opening/closing operations of the third on-off valve.

BRIEF DESCRIPTION OF THE DRAWINGS

FIG. 2A shows a steady state and FIG. 2B shows a state at a time of the self-excited vibration.

FIG. 3A shows a steady state and FIG. 3B shows a state at a time of the self-excited vibration.

BEST MODE FOR CARRYING OUT THE INVENTION

Embodiments according to the present invention will now be described hereinafter with reference to the drawings.

Figure 1:
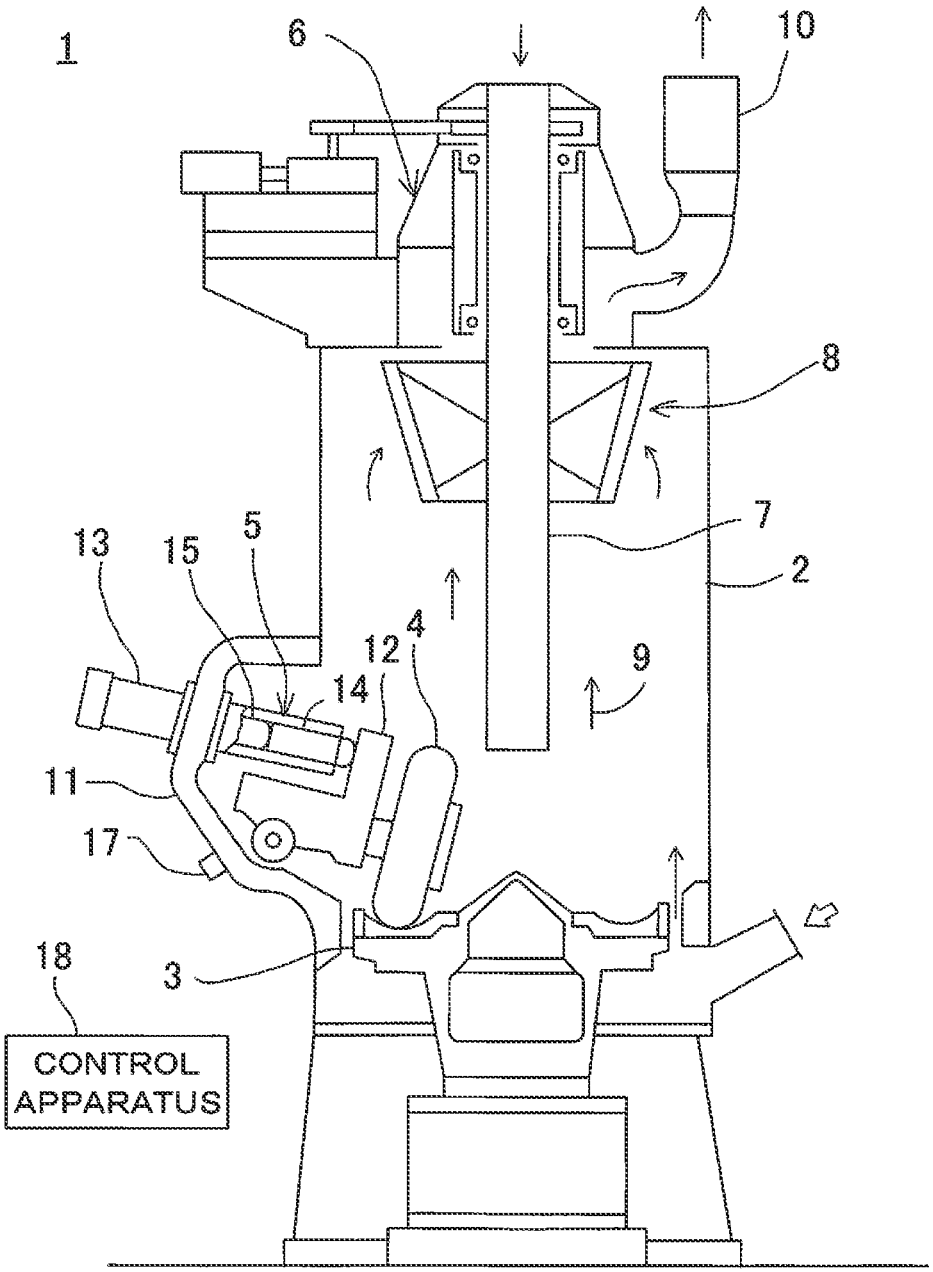
FIG. 1 is a schematic diagram showing an example of a vertical roller mill according to an embodiment of the present invention.

First, an example of an existing vertical roller mill 1 will now be briefly described with reference to FIG. 1.

A pulverization table 3 is provided at a lower portion of a housing 2, pulverization rollers 4 roll on the pulverization table 3, and the pulverization rollers 4 are provided radially at positions obtained by trisection in the circumferential direction and pressed against the pulverization table 3 by a roller pressure unit 5.

A coal supply and discharge portion 6 is provided above the housing 2, a pipe-like chute 7 is provided on a rotary shaft center line of the pulverization table 3, and the massive lump of coals from the chute 7 is supplied to a central portion of the pulverization table 3. Additionally, a classifier 8 that rotates around the chute 7 is provided at an upper portion of the housing 2.

The coal supplied onto the pulverization table 3 from the chute 7 is moved in the outer peripheral direction by the centrifugal force, pulverized into powder by the pulverization rollers 4, carried by the carrier air blown up from the outer periphery of the pulverization table 3, and moved up as a pulverized coal flow 9.

The pulverized coal flow 9 is classified into the pulverized coal corresponding to the predetermined particles or smaller particles by the classifier 8, and the classified pulverized coal is supplied to a pulverized coal burner (not shown) through a pulverized coal delivery tube 10 of the coal supply and discharge portion 6. Further, a coarse coal corresponding to the predetermined particles or larger particles fall onto the pulverization table 3 and will be pulverized by the pulverization rollers 4 again.

The roller pressure unit 5 is provided so as to pierce through a journal cover 11 constituting part of the housing 2, a roller arm 12 is provided at the journal cover 11 so as to freely tilt, and the roller pressure unit 5 is provided to the roller arm 12. The roller pressure unit 5 has a pressure cylinder 13 and a push rod 14, and the push rod 14 is provided so as to freely slide in the shaft center direction.

A rod 15 of the pressure cylinder 13 touches on a proximal end of the push rod 14, and a front end (a central side end) of the push rod 14 touches on the roller arm 12, and the pressing force of the pressure cylinder 13 is transferred to the pulverization roller 4 through the push rod 14 and the roller arm 12.

A vibration sensor 17, e.g., an acceleration sensor for detecting the vibration, is provided on the journal cover 11. It is to be noted that the vibration sensor 17 can be provided at any position as long as a part where the vibration can be detected. A result of the detection performed by the vibration sensor 17 is input to a control apparatus 18. The control apparatus 18 judges whether the self-excited vibration has occurred based on a vibration detection signal from the vibration sensor 17. When the control apparatus 18 determines the self-excited vibration or when the control apparatus 18 determines that the self-excited vibration will occur, the control apparatus 18 controls a hydraulic circuit 20 (which will be described later) that supplies a pressure oil to the pressure cylinder 13 and suppresses the self-excited vibration.

The hydraulic circuit 20 will now be described with reference to FIG. 2.

One end of a pressure oil supply path 21 communicate with a cylinder head side of the pressure cylinder 13, and the other end of the pressure oil supply path 21 communicate with an oil tank 22. A hydraulic pump 23 and a first on-off valve 24 are provided at the pressure oil supply path 21 from the upstream side. Further, a bypass path 25, which bypasses the first on-off valve 24 and enables the upstream side and the downstream side of the first on-off valve 24 to communicate with each other, is provided. An orifice valve 26 and a second on-off valve 27 are provided at the bypass path 25 from the upstream side.

An accumulator 28 is communicated with the upstream side of the first on-off valve 24 of the pressure oil supply path 21 or the upstream side of the orifice valve 26.

One end of an oil drain path 29 is communicated with the rod 15 side of the pressure cylinder 13, and the other end of the oil drain path 29 communicated with the oil tank 22. A third on-off valve 30 is provided at the oil drain path 29.

Here, the hydraulic circuit 20 functions as the pressure oil supplying means for the pressure cylinder 13 also functions as the self-excited vibration suppressing means.

An operation of the hydraulic circuit 20 in a steady operation will now be described.

Figure 2A:
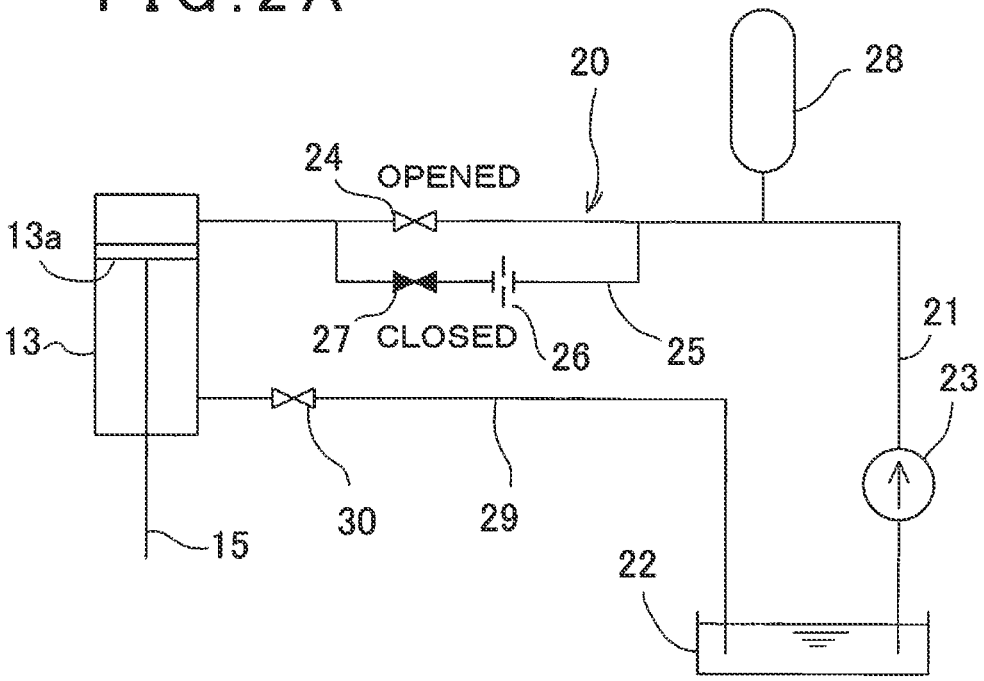
FIG. 2A and FIG. 2B are hydraulic circuit diagrams each showing a primary part of the embodiment, where

In the steady operation, the control apparatus 18 opens the first on-off valve 24 and the third on-off valve 30 and closes the second on-off valve 27 (FIG. 2A). The cylinder head of the pressure cylinder 13 communicates with the hydraulic pump 23 and the accumulator 28 through the pressure oil supply path 21.

The pressure oil pressurized by the hydraulic pump 23 is supplied to the cylinder head side of the pressure cylinder 13 through the pressure oil supply path 21 and each pulverization roller 4 is pressed against the pulverization table 3 by the pressure cylinder 13. The coal is pulverized.

Figure 2B:
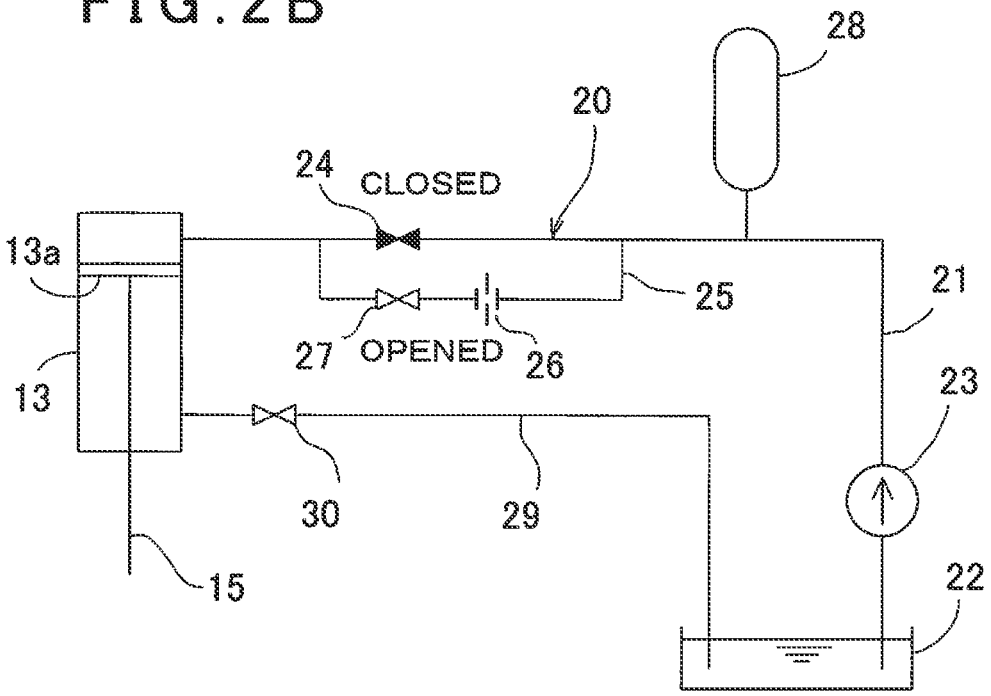

When the vibration detected by the vibration sensor 17 exceeds a predetermined value (a threshold value), the control apparatus 18 closes the first on-off valve 24, closes the third on-off valve 30, and opens the second on-off valve 27 (FIG. 2B). The cylinder head of the pressure cylinder 13 communicates with the accumulator 28 through the bypass path 25.

When the self-excited vibration occurs, the pulverization roller 4 vibrates up and down, and the vibration of the pulverization roller 4 is transferred to the roller arm 12, the push rod 14, and the rod 15.

The vibration of the rod 15 appears as the vibration of a piston 13*a* of the pressure cylinder 13 and a volume of the cylinder head side is fluctuated by the vibration of the piston 13*a*, and the pressure oil on the cylinder head side flows in and out. Although the pressure oil corresponding to the fluctuation of the volume flows in or out of the accumulator 28 through the bypass path 25 and the orifice valve 26, the vibration is attenuated by the viscosity resistance of the pressure oil in a process of flowing through the orifice valve 26. Further, since the orifice valve 26 only operates at the time of the self-excited vibration, the orifice characteristics can be specialized for the self-excited vibration only.

Therefore, by the fact that the pressure oil supplied to the pressure cylinder 13 is forcibly communicated through the orifice valve 26, the self-excited vibration can be suppressed. Furthermore, since the self-excited vibration is detected and then the self-excited vibration is suppressed, the self-excited vibration can be assuredly suppressed in the early stages of the self-excited vibration.

When the self-excited vibration is suppressed, based on a detection result obtained by the vibration sensor 17, the first on-off valve 24 and the third on-off valve 30 are opened, the second on-off valve 27 is closed, and the control returns to the steady operation (FIG. 2A).

Therefore, when the self-excited vibration has occurred, or when the self-excited vibration is about to occur, the self-excited vibration can be suppressed, and the operation can be continued without stopping the vertical roller mill 1.

In the foregoing embodiment, although the means for suppressing the self-excited vibration is provided at the pressure oil supply path 21 side, it may also be provided at the oil drain path 29 side, or it may be provided at both the pressure oil supply path 21 and the oil drain path 29.

It is to be noted that, in the foregoing embodiment, when the flow path resistance of the first on-off valve 24 is considerably small with respect to the orifice valve 26, the second on-off valve 27 may be omitted.

FIG. 3 shows a case where the means for suppressing the self-excited vibration is provided at both the pressure oil supply path 21 and the oil drain path 29. It is to be noted that a configuration of the pressure oil supply path 21 side is the same as that in the foregoing embodiment, and hence a description thereof will be omitted.

The third on-off valve 30 is provided at the oil drain path 29, an oil drain bypass path 32 for communicating with the upstream side and the downstream side of the third on-off valve 30 is provided, and an orifice valve 33 is provided at the oil drain bypass path 32. It is to be noted that the opening/closing operations of the first on-off valve 24, the second on-off valve 27, and the third on-off valve 30 are controlled by the control apparatus 18 (see FIG. 1).

Figure 3A:
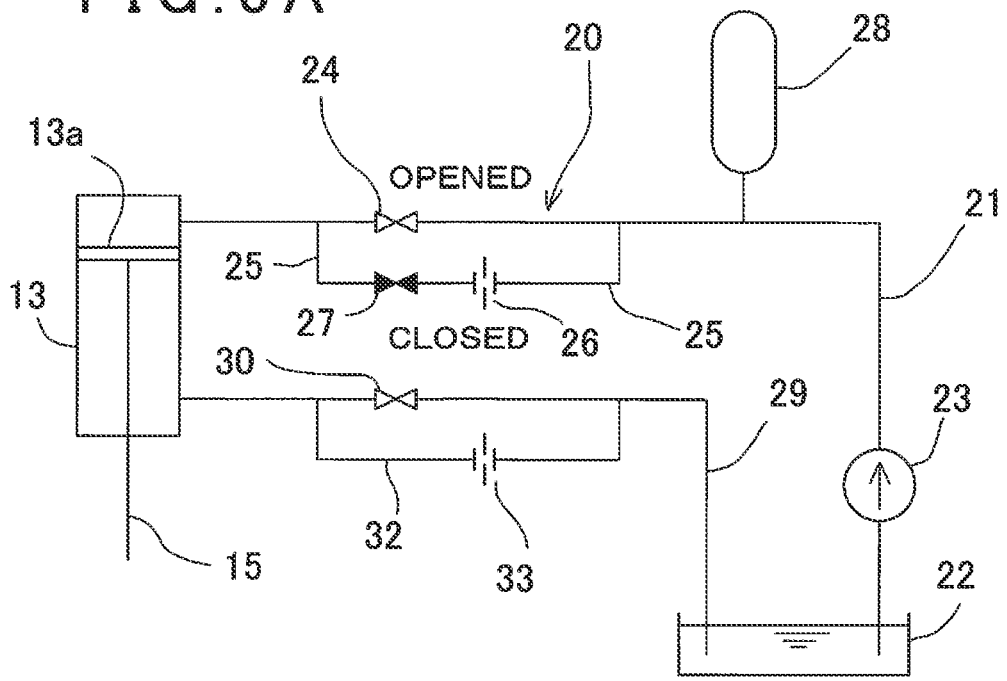
FIG. 3A and FIG. 3B are hydraulic circuit diagrams each showing a primary part of another embodiment, where

FIG. 3A shows a steady state of the vertical roller mill 1, the first on-off valve 24 and the third on-off valve 30 are opened, and the second on-off valve 27 is closed.

A pressure oil pressurized by the hydraulic pump 23 is supplied to the cylinder head side of the pressure cylinder 13 through the pressure oil supply path 21, each pulverization roller 4 is pressed against the pulverization table 3 by the pressure cylinder 13, and the coal is pulverized.

Figure 3B:
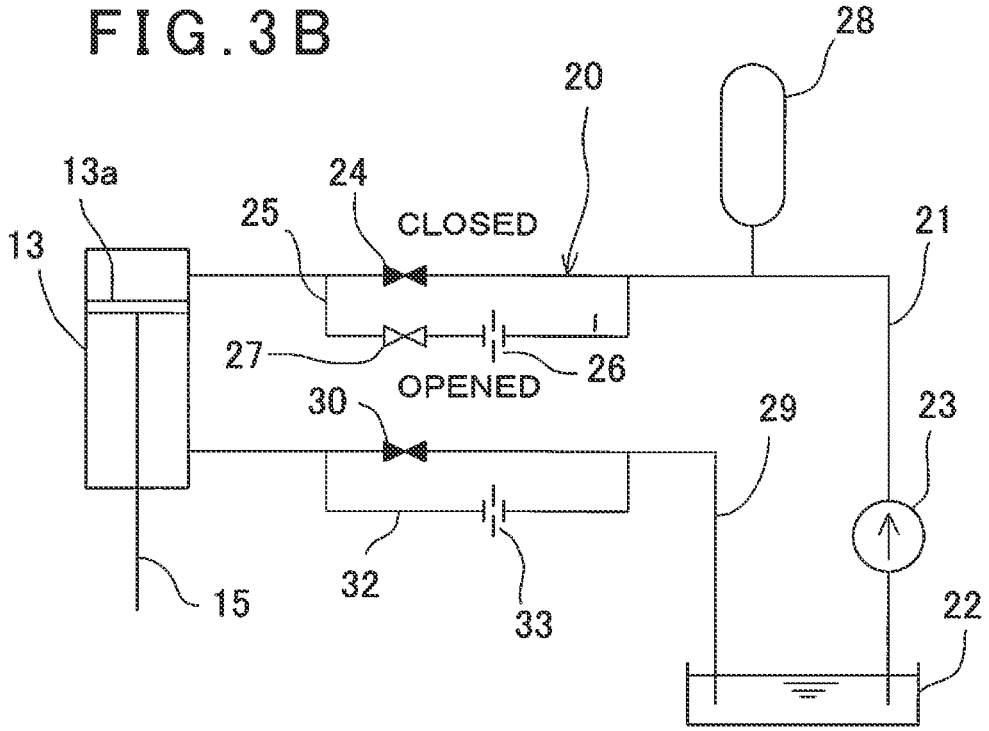

FIG. 3B shows a case where the self-excited vibration has occurred, the first on-off valve 24 is closed, the second on-off valve 27 is opened, and the third on-off valve 30 is closed.

When the first on-off valve 24 is closed, by the vibration of the piston 13*a* of the pressure cylinder 13, the pressure oil on the cylinder head side flow to and fro through the second on-off valve 27, and the vibration is suppressed.

At the same time, the third on-off valve 30 is closed, the oil in the pressure cylinder 13 on the rod 15 side flows to and fro through the orifice valve 33, and the vibration is suppressed.

When the vibrations are attenuated on the pressure oil supply path 21 side and the oil drain path 29 side respectively, the vibration suppressing effect can be further exerted. Furthermore, a burden at the time of suppressing the self-excited vibration can be dispersed to the pressure oil supply path 21 and the oil drain path 29.

It is to be noted that the self-excited vibration suppressing means may be configured on the oil drain path 29 side alone.

INDUSTRIAL APPLICABILITY

According to the present invention, a vertical roller mill, comprises a pulverization table which is accommodated in a housing, and rotated and driven by a table driving apparatus, two or more pulverization rollers which are pressed against the upper side of the pulverization table and pulverized massive lumps and two or more roller pressure units which press the pulverization rollers, wherein each of the roller pressure unit comprises a hydraulic cylinder which applies the pressing force to the pulverization roller, and a hydraulic circuit connected to the hydraulic cylinder, wherein an accumulator communicates with a pressure oil supply path of the hydraulic circuit, a first on-off valve is provided at the downstream side of a communicating position of the accumulator in the pressure oil supply path, a first bypass path which communicates with the downstream side of the communicating position of the accumulator in the pressure oil supply path and communicates with the downstream side of the on-off valve, and bypasses the on-off valve is provided, a first orifice valve and a second on-off valve are provided in the first bypass path, wherein the first on-off valve is opened and the second on-off valve is closed in a steady operation of the vertical roller mill, the first on-off valve is closed and the second on-off valve is opened at a time of the occurrence of the self-excited vibration so that a flow of an oil to the hydraulic cylinder due to the self-excited vibration is caused through the first orifice valve. As a result, at the time of the occurrence of the self-excited vibration, the vibration is attenuated due to the viscosity resistance of the oil flowing through the orifice valve, and the occurrence of the self-excited vibration is suppressed, or the self-excited vibration is suppressed. Furthermore, since the first orifice valve only operates at the time of the self-excited vibration, its performance can be specialized for the self-excited vibration only.

Further, according to the present invention, a third on-off valve is provided at an oil drain path communicating with the hydraulic cylinder, a second bypass path that bypasses the third on-off valve is provided, a second orifice valve is provided in the second bypass path, wherein the third on-off valve is opened in the steady operation of the vertical roller mill, and the third on-off valve is closed at a time of the occurrence of the self-excited vibration so that a flow of the oil in the oil drain path due to the self-excited vibration is caused through the second orifice valve. As a result, the self-excited vibration can be suppressed in both the pressure oil supply path and the oil drain path, and a burden at the time of suppressing the self-excited vibration can be dispersed to the pressure oil supply path and the oil drain path. Furthermore, the vibration can be supressed by both the first orifice valve and the second orifice valve, supressing the self-excited vibration effectively.

Further, according to the present invention, the vertical roller mill further comprises a control apparatus and a vibration sensor for detecting the vibration, wherein the control apparatus judges the occurrence of the self-excited vibration based on a detection result of the vibration sensor, and controls the opening/closing operations of the first on-off valve and the second on-off valve. As a result, the self-excited vibration can be assuredly suppressed in the early stages of the occurrence of the self-excited vibration.

Furthermore, according to the present invention, the vertical roller mill further comprises, a control apparatus and a vibration sensor for detecting the vibration, wherein the control apparatus judges the occurrence of the self-excited vibration based on a detection result of the vibration sensor and controls the opening/closing operations of the third on-off valve. As a result, the self-excited vibration can be assuredly suppressed in the early stages of the occurrence of the self-excited vibration.

LEGEND OF REFERENCE NUMERALS

1 Vertical roller mill
2 Housing
3 Pulverization table
4 Pulverization roller
5 Roller pressure unit
11 Journal cover
12 Roller arm
13 Pressure cylinder
14 Push rod
15 Rod
17 Vibration sensor
18 Control apparatus
20 Hydraulic circuit
21 Pressure oil supply path
22 Oil tank
23 Hydraulic pump

24 First on-off valve
25 Bypass path
26 Orifice valve
27 Second on-off valve
28 Accumulator
29 Oil drain path
30 Third on-off valve
32 Oil drain bypass path
33 Orifice valve

The invention claimed is:

1. A vertical roller mill, comprising a pulverization table which is accommodated in a housing, and rotated and driven by a table driving apparatus, two or more pulverization rollers which are pressed against the upper side of said pulverization table and pulverized massive lumps and two or more roller pressure units which press said pulverization rollers, wherein each of said roller pressure units comprises a hydraulic cylinder which applies the pressing force to said pulverization roller, and a hydraulic circuit connected to said hydraulic cylinder, wherein an accumulator communicates with a pressure oil supply path of said hydraulic circuit, a first on-off valve is provided at the downstream side of a communicating position of said accumulator in said pressure oil supply path, a first bypass path is provided which communicates with the downstream side of said communicating position of said accumulator in said pressure oil supply path and communicates with the downstream side of said on-off valve, and wherein said first bypass path bypasses said on-off valve, and wherein a first orifice valve and a second on-off valve are provided in said first bypass path, wherein said first on-off valve is opened and said second on-off valve is closed in a steady operation of said vertical roller mill, said first on-off valve is closed and said second on-off valve is opened at a time of the occurrence of the self-excited vibration so that a flow of an oil to said hydraulic cylinder due to the self-excited vibration is through said first orifice valve.

2. The vertical roller mill according to claim 1, wherein a third on-off valve is provided at an oil drain path communicating with said hydraulic cylinder, a second bypass path that bypasses said third on-off valve is provided, a second orifice valve is provided in said second bypass path, wherein said third on-off valve is opened in the steady operation of said vertical roller mill, and said third on-off valve is closed at a time of the occurrence of the self-excited vibration so that a flow of said oil in said oil drain path due to the self-excited vibration is caused through said second orifice valve.

3. The vertical roller mill according to claim 2, further comprising, a control apparatus and a vibration sensor for detecting the vibration, wherein said control apparatus judges the occurrence of the self-excited vibration based on a detection result of said vibration sensor and controls the opening/closing operations of said third on-off valve.

4. The vertical roller mill according to claim 1, further comprising, a control apparatus and a vibration sensor for detecting the vibration, wherein said control apparatus judges the occurrence of the self-excited vibration based on a detection result of said vibration sensor, and controls the opening/closing operations of said first on-off valve and said second on-off valve.

* * * * *